United States Patent [19]

Everett

[11] 4,267,965

[45] May 19, 1981

[54] OIL BURNER CONTROL SYSTEM WITH FLUE DAMPER ADAPTER CIRCUIT

[75] Inventor: William F. Everett, Goshen, Ind.

[73] Assignee: Johnson Controls, Inc., Milwaukee, Wis.

[21] Appl. No.: 941,963

[22] Filed: Sep. 13, 1978

[51] Int. Cl.[3] ..... F23N 3/00; G05D 23/00

[52] U.S. Cl. ..... 236/1 G; 431/20

[58] Field of Search ..... 431/20, 21; 236/1 G

[56] References Cited

U.S. PATENT DOCUMENTS

| | | | |
|---|---|---|---|
| 3,010,451 | 11/1961 | Hodgins | 236/1 G |
| 3,273,625 | 9/1966 | Holtzman | 431/20 |
| 4,005,820 | 2/1977 | Cress | 431/20 |
| 4,084,743 | 4/1978 | Matthews . | |
| 4,087,045 | 5/1978 | Matthews | 236/1 G |
| 4,157,785 | 6/1979 | Freliech | 431/20 |

OTHER PUBLICATIONS

Specification Sheet for Stack Pack, ©1976, Flair Manufacturing Corp.

Automatic Stack Damper, Installation Instructions, Trionic Industries, Inc.

Popular Science, "Pros and Cons of Automatic Flue Dampers."

Seris M15, Y15, Automatic Vent Damper System, Johnson Controls, Inc. Penn Division.

*Primary Examiner*—George E. Lowrance

*Attorney, Agent, or Firm*—Emrich, Root, Lee, Brown & Hill

[57] ABSTRACT

An adapter circuit for retrofitting an oil burner control system with a flue damper includes a source of energy in circuit with the thermostat for energizing the damper motor in response to a call for heat to open the damper. A first relay in the adapter circuit includes a pair of contacts for simulating the operation of the thermostat contacts. When the damper is open, this relay is energized, and its contacts close, simulating the operation of the thermostat after the damper is opened, to energize the burner control circuit, thereby energizing the burner motor and ignition. A second relay in the adapter circuit senses whether the burner motor is energized; and when the burner motor is de-energized, this relay initiates a time delay after which the adapter circuit closes the damper.

18 Claims, 3 Drawing Figures

OIL BURNER CONTROL SYSTEM WITH FLUE DAMPER ADAPTER CIRCUIT

BACKGROUND AND SUMMARY

The present invention relates to an oil burner control system; and more particularly, it is directed to an adapter circuit for retrofitting an existing oil burner control system with a flue damper. Such control systems may be used with an oil burning furnace or other oil burning unit.

Flue damper assemblies, including a rotatable damper plate and a damper operator, together with limit switches which may be cam-operated, are commercially available, and have been used extensively in both gas and oil burning units as a means of saving energy by reducing heat loss through the flue after the burner is shut off and combustion products have been exhausted through the flue. The desirability of flue dampers has increased substantially with fuel shortages and the high cost of fuel, so there is a substantial market for retrofitting existing furnaces and the like, and in such cases, the circuitry which interfaces the damper assembly with the existing thermostat and oil burner control system is referred to as the "oil damper adapter" or, simply, the adapter circuit.

Adapter circuits for oil burner control systems are also commercially available, but present commercially available adapter circuits have one or more disadvantages. For example, some damper adapter systems presently available require that the adapter circuit carry the full electrical load, rather than having the load carried by the oil burner control system which is intended for this purpose. Thus, the adapter circuits presently available require re-wiring of the line voltage hook-up between the oil burner control and the motor and ignition circuits. Another disadvantage of some commercially available damper adapter arrangements is that by incorporating them into an existing system, they interfere with the safety timing on the oil burner control. That is, after the oil burner control system is retrofitted with a flue damper, the timing permitted by the oil burner control to sense a burner flame after power has been applied to the burner motor and ignition is reduced by the time required for the damper to open; and this may result in false lockouts by the oil burner control system. Briefly, the present invention overcomes these disadvantages, and further, adds significant safety features such as an interlock between the damper and the line voltage motor and ignition circuit such that if the oil burner motor and ignition are energized, through fault or tampering by an unskilled person, the damper will be driven to the open position, independent of the operation of the thermostat in the low voltage circuit. Further, an exhaustive and detailed fault analysis of the present system indicates that there is no safety hazard presented with any single fault or with any realistic occurrence of multiple faults in any of the subsystems including the thermostat, the oil burner control circuit, the damper assembly, the damper operator circuit or the oil damper adapter circuit.

The adapter circuit of the present invention includes a source of energy in circuit with the thermostat for energizing the damper operator motor in response to a call for heat to drive the damper plate to the open position prior to energizing the oil burner motor and ignition circuit. A first relay in the adapter circuit includes a pair of contacts for simulating the operation of the thermostat contacts. This relay is not energized until the damper plate has reached the open position; and when the relay is energized, its contacts close to simulate the operation of the thermostat and generate a control signal to energize the burner control circuit. Thus, the burner motor and ignition are energized by the existing oil burner control circuit relay and the safety timing required for sensing the main burner flame is not diminished by the time required for opening the flue. This first relay in the adapter circuit is sometimes referred to as the "simulating" relay because, as indicated, its contacts simulate the operation of the contacts of the thermostat during a call for heat.

A second relay, sometimes referred to as the "safety" relay in the adapter circuit senses whether the burner motor and ignition are energized. When the oil burner motor is de-energized, the safety relay initiates a time delay after which the adapter circuit closes the damper. This safety relay also provides an interlock between the line voltage supplied to the motor and ignition circuit of the conventional oil burner control system and drives the damper to the open position whenever the oil burner motor and ignition circuit is energized independent of the condition of the thermostat in the low voltage circuit. Thus, in the event of a fault or deliberate tampering with the low voltage control circuit in an effort to cause the furnace to come on, the damper will be driven to the open position.

Another advantage of the present invention is that it facilitates retrofitting an existing oil burner control system with a flue damper by having a separate housing for the adapter circuit which is designed to be mounted in the furnace adjacent the existing oil burner control box and without having to cut or rewire any of the existing leads in the oil burner control. Only splices are required for interfacing the oil burner control with the adapter circuit, and the thermostat wires are routed directly to the adapter circuit. Further, connections to the damper operator assembly are facilitated by a cable and polarized end plugs interfacing the adapter circuit with the damper operator, thus avoiding possible mis-wiring or tampering. Other features and advantages, both operational and safety, will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
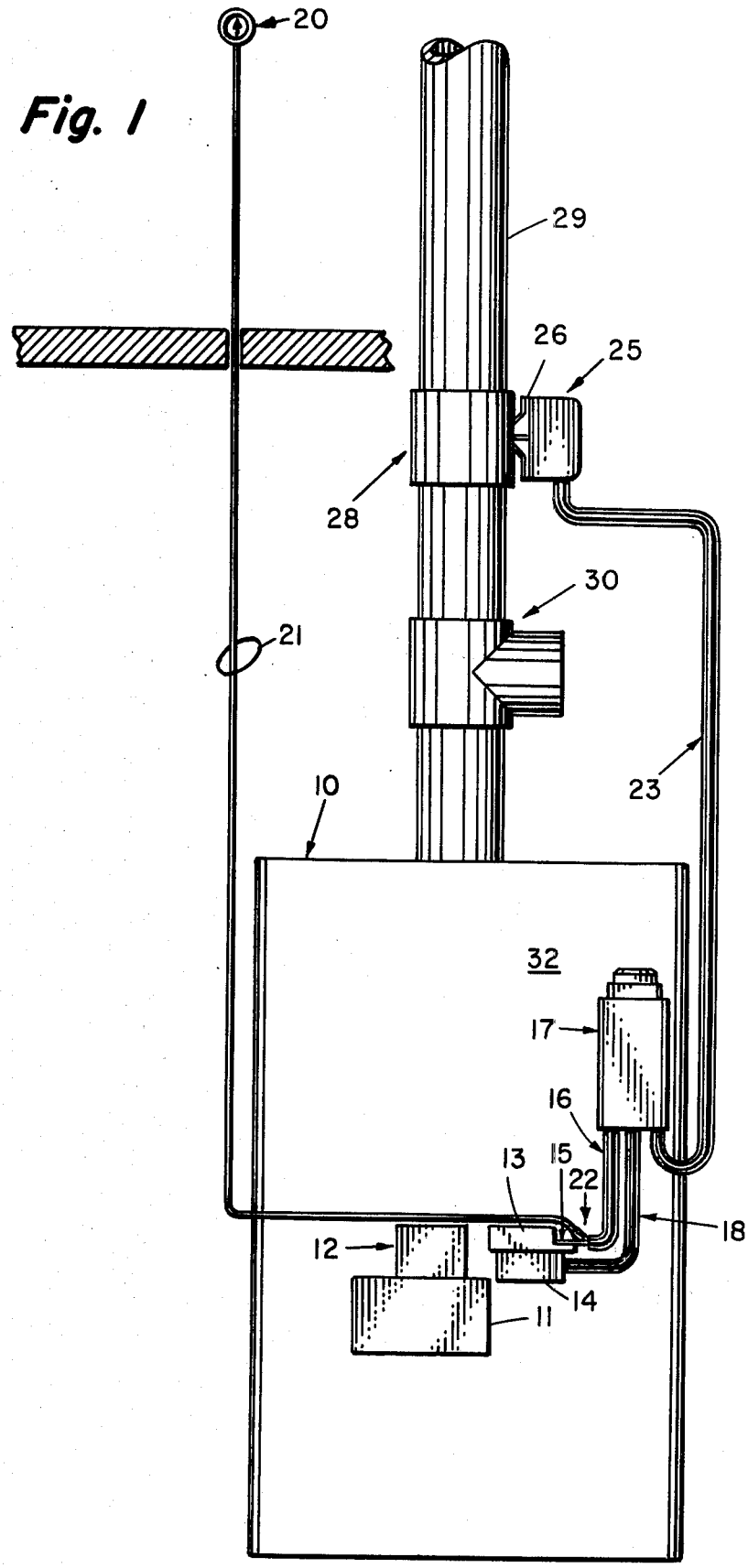
FIG. 1 is a diagrammatic illustration showing the incorporation of a flue damper assembly and oil damper adapter circuit in an otherwise conventional oil burner control system.

Referring now to FIG. 1, reference numeral 10 generally designates a casing or housing for an oil burning furnace or other oil burning unit. An oil burner motor 11 includes a pump for feeding oil to a burner and also energizes a blower. The oil burner ignition system is generally designated 12, and its function is to ignite the fuel. A case 13 houses the oil burner control and is mounted to a conduit box 14. The case 13 includes a terminal block 15 for connecting three of the five wires from a cable 16 which extends to a housing 17 in which the damper adapter control circuitry is housed. A second three-wire cable 18 extends from the conduit box 14 to the case 17 for the adapter circuit. A room thermostat generally designated 20 includes two wires 21 from the heat contacts (THS) and which are butt-spliced at 22 into two of the wires comprising the cable 16.

A four-wire cable 23 with polarized end plugs is interconnected between the adapter circuit in the case 17 and a damper operator generally designated 25 which actuates a damper plate by means of a shaft 26, the damper assembly being generally designated by reference numeral 28 and assembled, as illustrated, to a flue pipe 29 through which the combustion gases from the furnace exhaust to a chimney. A barometric damper generally designated 30 is also connected to the flue pipe 29 between the fire box of the furnace and up stream (in terms of flow of flue gas) of the flue damper 28. The barometric damper 30 may be any conventional barometric damper which is responsive to a predetermined pressure within the flue pipe above the fire box to exhaust to the ambient.

One of the features of the present invention is that the circuitry required for adapting an existing installation to include a flue damper such as the one designated 28, includes all of the circuit components assembled within a single housing 17 which may be mounted to an interior wall, for example the one designated 32 of the furnace in proximity to the terminal block 15 of the oil burner control and the conduit box 14. The thermostat wires are simply disconnected from the terminal block 15 and butt-spliced into the cable 16 leading from the case 17 to the terminal block 15. The cable 23 is normally provided with the damper assembly 28 and control 25. The cable 18 is all that is necessary to complete the installation. Thus, with the present system, retrofitting of an existing installation with an energy saving flue damper becomes a relatively straightforward task without major modification to any of the existing burner control circuitry or any substantial revisions to the furnace itself.

Figure 2:
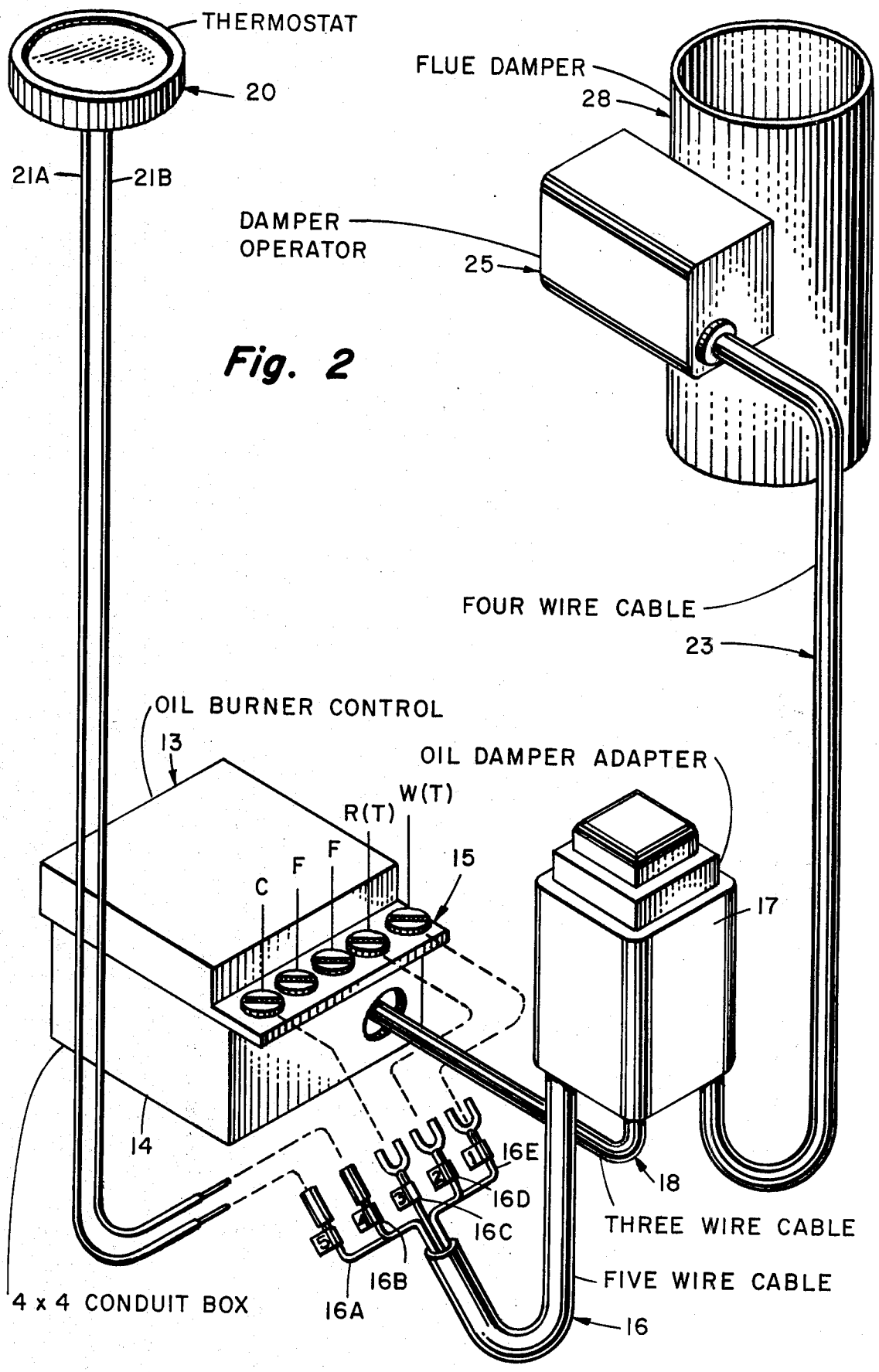
FIG. 2 is a perspective view illustrating the mechanical portions and housings for the circuitry of the system of FIG. 1.
Figure 3:
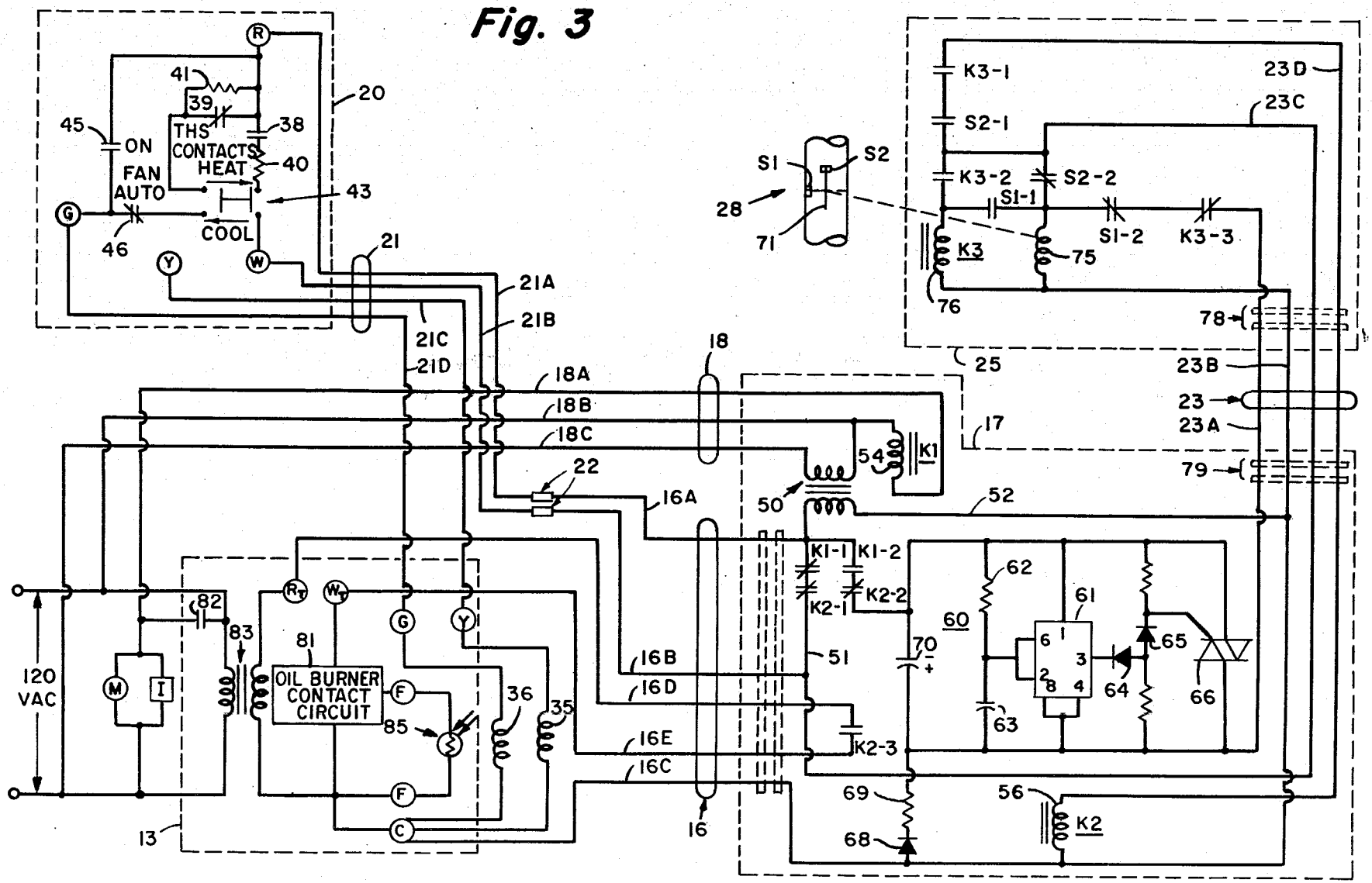
FIG. 3 is a circuit schematic diagram of an oil burner control system provided with a flue damper assembly and damper adapter circuit according to the present invention.

Turning now to FIG. 2, there is given a better illustration of the various mechanical elements of the system. The two leads from the thermostat 20 are designated 21A and 21B; and they are directly connected to leads 16A and 16B of the five-wire cable 16. A third wire 16C is connected to terminal C of the terminal block 15; and wires 16D and 16E are connected to the two normal thermostat terminals, designated respectively R(T) and W(T). The oil damper adapter case 17, as mentioned, is normally mounted directly to the furnace at a convenient distance from the oil burner control housing 13 and the conduit box 14 so as to minimize the length of the cable 18. The four-wire cable extending from the adapter circuitry to the damper operator 25 may be routed in any convenient manner depending upon the structure of the furnace. The two terminals designated F,F are connected to the flame sensor which may either be a conventional heat sensor or a photosensor such as a cadmium cell. Referring now to FIG. 3, the various circuit elements are enclosed within dashed blocks which diagrammatically represent the corresponding physical separation of elements just discussed. Thus, the components enclosed within the dashed line 20 are part of the thermostat. The elements enclosed within the block 13 form the oil burner control; those enclosed within the dashed line 17 form the oil damper adapter circuit; and those enclosed within the dashed line 25 comprise the damper operator. Similarly, the cables 16, 18 and 23 are grouped together and identified with corresponding designations. In addition, the cable 21 from the thermostat includes a lead 21C which is connected to one terminal of an air conditioner relay 35, and a lead 21D which is connected to the coil 36 of a relay 36 which operates a blower fan for forced air systems.

Referring first to the thermostat 20, it includes a pair of normally open contacts 38 and a pair of normally closed contacts 39. A heat anticipator resistor 40 is connected in series with the contacts 38; and at cooling anticipator resistor 41 is connected in parallel with the contacts 39. A switch generally designated 43 is operated between a HEAT position (to the right in FIG. 3) and a COOL position (to the left in FIG. 3), with an intermediate position if desired for shutting down the system. A set of normally open contacts 45 is connected between the R terminal of the thermostat and the G terminal which is connected by means of lead 21D to the fan relay 36. The fan relay contacts (not shown) are closed by relay 36 which is energized with the fan switch is placed in the ON position. A set of normally closed contacts 46 is connected between the G terminal of the thermostat and one terminal of the COOL position of the switch 43. The thermostat 20 is a conventional apparatus and the present system may be used with thermostats other than the one illustrated.

In operation, when the switch 43 is in the HEAT position and the bimetallic element signals a call for heat, the contacts 38 close presenting a closed circuit between the R and W terminals connected respectively to the leads 21A and 21B which are, in turn, coupled by means of the butt splices 22 to one terminal of the secondary winding of transformer 50 located in the adapter circuit, and to a lead 51 via lead 16B. The other terminal of the secondary winding of transformer 50 is connected to a lead 52 which is connected to the system common, which is ultimately connected to terminal C of the previously described terminal block 15 in the oil burner control circuit 13.

The primary winding of transformer 50 is connected across a conventional 120 V. 60 Hz. source.

OIL DAMPER ADAPTER CIRCUIT

The transformer 50 just described is a part of the adapter circuit, and it comprises a source of low voltage energy which is connected to the damper operator 25, when the thermostat contacts 38 are closed, via leads 23B and 23C.

Also included within the adapter circuit are a first relay K1 including a coil 54 having one terminal connected to the 60 Hz. source via lead 18B and the other terminal connected to the oil burner motor M and ignition circuit I, via lead 18A. The relay K1 includes a first set of normally closed contacts K1-1 and a set of normally open contacts K1-2, both of which are connected to the secondary of the transformer 50 as illustrated. The relay K1 is sometimes referred to as a safety relay because one of its functions is to interlock the damper operator 25 with the oil burner motor and ignition circuit to drive the damper to the open position in the event energy is supplied to the oil burner motor and ignition circuit, as will be described in more detail below.

The adapter circuit includes a second relay K2, having a coil 56 which is connected via lead 23D to the damper operator 25, and also including two sets of normally closed contacts K2-1 which are connected between the lead 51 and the previously described normally closed contacts K1-1, and K2-2 which are connected between the previously described normally open contacts K1-2 and the input of a delay circuit generally designated 60. The relay K2 also includes a set of normally open contacts K2-3 which simulate the operation of the thermostat heat contacts 38, as will be described presently. The contacts K2-3 are connected via leads 16D and 16E to the R(T) and W(T) contacts of the oil burner control 13.

The delay circuit 60 includes a timer circuit 61 which may be a commercially available type 555 timer. An input resistor 62 and capacitor 63 are connected as shown converting the timer 61 to a delay circuit operation, as is known in the art. The amount of the delay is determined by the values of resistor 62 and capacitor 63, and in the illustrated embodiment, the delay is adjusted to be 150 seconds±30 seconds, depending upon the application.

The output of the timer circuit 61 is connected via diodes 64, 65 to the gate lead of a silicon control rectifier (SCR) 66. The anode of the SCR 66 is connected via lead 23A to the damper operator 25, and the cathode of the SCR 66 is connected to the relay contacts K2-2. A diode 68 and resistor 69 are connected in series with the system common via lead 16C; and they cooperate with a capacitor 70 connected across the bias terminals of the timer 61 to establish a DC voltage in the polarity indicated when the delay circuit is energized.

DAMPER OPERATOR AND DAMPER ASSEMBLY

The damper assembly 28 includes a damper plate 71 shown in FIG. 3 in the open position in solid line, and in the closed in dashed line. The damper includes a first cam-actuated switch S1 located at the damper closed position, and a second cam-actuated switch S2 located at the damper open position. The switch S1 has a first set of normally open contacts S1-1 and a set of normally closed contacts S1-2, both of which are schematically illustrated within the damper operator block 25. Similarly, the damper open switch S2 includes normally open contacts S2-1 and normally closed contacts S2-2. The coil of the damper operator motor is designated 75, and when it is actuated it rotates the damper plate 71. The rotation of the damper plate 71 is in the same direction—that is, it is not reversed—so that for each 90° of rotation of the damper plate 71, the damper plate alternately assumes a closed and an open position. A relay K3 includes a coil 76 and first and second sets of normally open contacts K3-1, K3-2, and a set of normally closed contacts K3-3. One terminal of the motor 75 and the coil 76 are connected to system common via cable lead 23B. The other terminals of these two elements are interconnected by normally open contacts S1-1. The anode of SCR 66 is connected to the other terminal of the motor winding 75 by means of normally closed contacts K3-3 and normally closed contacts S1-2. The wire 51 (connected to one of the thermostat contacts by leads 21B and 16B) is connected to the normally closed contacts S2-2 and the normally open contacts K3-2 by means of cable lead 23C. The other terminals of these two sets of contacts are connected respectively to the motor winding 75 and to the coil 76 of relay K3. One terminal of the coil 56 of relay K2 in the adapter circuit is connected by means of cable lead 23D and the series combination of normally open contacts K3-1 and S2-1 to the junction between the contacts K3-2 and S2-2 as illustrated. The cable 23 is connected to the damper operator by means of a polarized plug 78, and to the adapter circuit by a similar plug 79.

OIL BURNER CONTROL

The oil burner control includes an oil burner contact circuit 81 which, when energized by the control signal from the adapter circuit, closes the main oil burner contactor 82 connected between line voltage and the oil burner motor and ignition circuit. A transformer 83 has its primary winding connected to the line voltage and its secondary connected between terminal R(T) and the low voltage system common, terminal C. A cadmium photodetector 85 is connected between the terminals F,F, one of which is coupled to the coil burner contact circuit 81, and the other of which is connected to the low voltage system common.

OPERATION

When the thermostat 20 calls for heat, with the function switch 43 in the HEAT position, the contacts 38 close, thereby coupling the secondary of transformer 50 across the cable leads 23B, 23C, and sending a signal to the damper operator 25. This voltage is connected across the motor winding 75 because, under normal operation, the damper plate 71 will be closed and the cam-actuated switch S2 will not be actuated, so normally-closed contacts S2-2 will be closed. This same signal is also connected across the winding 76 of relay K3 because switch S1 in the damper assembly will be actuated when the damper plate is in the closed position. Relay K3 latches "on" via contacts K3-2, and is sometimes referred to as a latching relay.

After approximately 5° of rotation of damper plate 71 toward the open position, cam switch S1 is deactuated and contacts S1-1 open (isolating the damper motor from relay K3) while contacts S1-2 close (preparing the operator for subsequent actuation by SCR 66 to return the damper plate to the closed position). When the damper plate is in the fully open position, after having been rotated 90° to the position shown in solid line in FIG. 2. the switch S2 is cammed to the actuated state, and contacts S2-2 open, thereby de-energizing the motor 75, and the damper operator will remain in this state, under normal operating conditions, until the adapter circuit sends a further signal along line 23A from the timer 61, as will presently be described. It will be appreciated, however, that in this state, contacts S1-2 are closed.

When the damper plate 71 reaches the open position, switch S2 also closes contacts S2-1, and the voltage on line 51 is thus transmitted through contacts S2-1 and K3-1 (both being closed at this time), back to the adapter circuit to energize the coil 56 of relay K2. As already indicated, one of the functions of relay K2 is to simulate the operation of the thermostat contacts 38 to transmit a signal (sometimes referred to as a "control signal") representative of a call for heat to the oil burner control. This is done by closing contacts K2-3. When these contacts close, the secondary of transformer 83 energizes the oil burner contact circuit 81 which, in turn, closes contacts 82 to supply line voltage to the oil burner motor M and ignition circuit I. Normal burner ignition and operation thus commence, and normal safety timing for sensing burner flame by means of the sensor 85 is also permitted. This signal is fed to the oil burner contact circuit 81 in a conventional manner.

When relay K2 is energized, it also opens contacts K2-1 (providing one phase of a safety interlock to be discussed), and opens contacts K2-2 to prevent a signal from being transmitted to the delay circuit 60.

When the contactor 82 closes to supply line voltage to the oil burner motor and ignition circuit, the coil 54 of the safety relay K1 in the adapter circuit is short-circuited, and it thereby becomes de-energized. Thus, contacts K1-1 open and contacts K1-2 close. However, the delay circuit 60 is not energized at this time, because contacts K2-2 are open.

Operation of the system continues under normal conditions, and it will be appreciated that the adapter circuit does not carry the full load current to the oil burner motor M or ignition circuit I. Normal operation continues with the oil burner control in command of the oil burning unit. As indicated, the safety timing of the oil burner control is not affected.

Normal operation continues until the thermostat opens contacts 38. When these contacts open, the source of power (transformer 50) in the adapter circuit is disconnected from line 51 which had supplied electrical energy along lead 23C to the coil 76 of relay K3. Thus, latching relay K3 becomes de-energized, thereby opening contacts k3-1 and de-energizing the coil 56 of the simulating relay K2.

When relay K2 becomes de-energized and contacts K2-3 open, the oil burner contact circuit 81 is de-energized, and the contactor 82 opens to de-energize the oil burner motor M and ignition circuit I. This causes the line voltage to appear across the coil 54 of relay K., thereby closing contacts K1-1. When relay K2 becomes de-energized, contacts K2-2 also close. Thus, a signal is transmitted to the input of the delay circuit 60 in response to the de-energization of the oil burner motor and ignition circuit. After a delay of a predetermined time (150±30 seconds) the SCR 66 is triggered by the output of the timer circuit 61, and the voltage is communicated from the transformer 50 through the closed contacts K1-2, the normally closed contacts K2-2, the anode/cathode terminals of the SCR 66, lead 23A, normally closed contacts K3-3, and normally closed contacts S1-2 to the motor 75 to rotate the damper plate 71 to the closed position. When the damper plate actuates switch S1, contacts S1-2 open, thereby de-energizing the motor 75, and initializing the system for the next cycle of operation. The delay time of circuit 60 may be adjusted according to circumstances. The delay may, in some cases, be eliminated, in which case the circuit reduces to a drive circuit including the SCR 66 and its associated gate circuitry.

To summarize the salient features and advantages of the present invention, some of which have already been mentioned, it will be observed that the contactor 82 of the oil burner control continues to make and break the power to the oil burner motor M and ignition circuit I, just as if the adapter circuit 17 and damper operator 25 had not been added to the system. Further, no electrical path between the oil burner control 13 and the oil burner motor and ignition is broken. The adapter circuit, therefore, does not carry any of the motor load current. Transformer 50 has its primary winding connected directly across the line voltage without breaking into any path, and the coil of relay K1 is connected between one terminal of line voltage and the junction between contactor 82 and the oil burner motor M (via lead 18A), but again without breaking any electrical path between the oil burner control and the burner motor and ignition circuit.

Another feature is that the safety timing on the oil burner control is not affected by the addition of the adapter circuit 17 and the damper. The reason for this is that the relay K2 and contacts K2-3 simulate a call for heat and transmit a corresponding signal to the oil burner control only after the switch S2 of the damper assembly has been actuated after the damper plate 71 is in the opened position, thereby closing contacts S2-1 and coupling a signal to the coil 56 of relay K2.

Another advantage is the safety feature provided by the relay K1. In the event power is supplied to the oil burner motor and ignition circuit (as might be caused by miswiring or deliberate rewiring of the low voltage thermostat circuit in an attempt to cause the furnace to come on), relay K1 will be de-energized; and contacts K1-1 will close. Since relay K2 is normally de-energized when there is no call for heat from the thermostat anyway, contacts K2-1 will be closed, and an interlock path is provided from the power source of transformer 50 to the line 51, causing the damper operator motor 75 to be energized and driving the damper plate 71 to the opened position. Contacts K1-2 provide a further interlock preventing a signal to the delay circuit 60 so that the damper plate cannot be closed as long as the oil burner motor is energized.

Safety relay K1 also is operative in the case of an inadvertent mis-wiring of the lead 18A directly to the line voltage, rather than to the junction between the contactor 82 and the motor and ignition circuit, as illustrated in FIG. 3. This would have the same effect as if the motor contactor 82 were welded closed. In this event, the Motor and Ignition circuit are energized, and the coil 54 of relay K1 is de-energized. In this case, the damper will be driven to the open position and remain there because contacts K1-2 will remain open, and a signal cannot be communicated to the delay circuit 60 and timer 61 as is required to close the damper. This prevents a condition in which the appliance is on and the damper closed, a condition found to be possible in some competitive systems.

In the event of a power failure to the system, the adapter control circuit causes the system to completely re-cycle when power is applied. Thus, should a failure cause a power interruption (for example, in tripping a current-limiting breaker or blowing a fuse during maintenance), the system will re-cycle when power is re-applied. This cycling of the system is advantageous in that it checks the operation of system components when power is re-applied. The same failure that caused the power interruption may also have caused component damage, particularly if the power interruption were caused, for example, by a lightning strike.

If a power interruption occurs when the damper plate is closed, the system will function normally when power is re-applied. If power is interrupted when the damper is opening, relay K2 is de-energized, and when power is re-applied, the relay K2 is not energized because latching relay K3 in the damper operator 25 is isolated (contacts S1-1 and K3-2 are opened). Thus, the call for heat signal will energize the damper motor 75 to drive the damper plate to the open position, but the timer 61 will also be triggered because relay K1 is energized and relay K2 is not energized so a signal is transmitted to the damper operator through contacts K3-3 and S1-2 to energize the damper motor and drive the damper plate back to the closed position, in which case, if a call for heat continues, the system will re-cycle normally. The same operation occurs if power is lost when the damper is open since relay K3 drops out and cannot be re-energized when power is re-applied, thereby de-energizing the coil of simulating relay K2, and re-cycling the damper plate to the closed position. Thus, the system re-cycles itself automatically upon power interruption to insure that all system components are functioning properly before the appliance is fired.

A fault analysis of the adapter circuit 17 and damper operator 25 shows no instance in which the oil burner motor was energized and the flue damper closed with the failure of a single element, such as the welding of relay contacts. Further, the system has been designed such that in many cases, the failure of a single component will produce a system lockout. This has the advantage that should more than one fault occur, the occurrence of the first fault will cause a lockout so that the second fault does not produce an unsafe condition. In this regard, the present system is safer than presently available oil burner damper control systems even when considering remote or unlikely failure conditions.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In combination with an oil burning unit having a burner motor and ignition circuit; oil burner control means for energizing said burner motor and ignition circuit in response to a control signal; and a thermostat in a space to be heated by the unit for generating a call-for-heat signal, said unit exhausting combustion gases through a flue, the improvement comprising:

a flue damper assembly including a damper plate movable between an open position and a closed position;

damper operator means including a second motor for driving said damper plate to said positions and including means for generating a first signal when said damper plate is in said closed position and a second signal when said damper plate is in said open position; and adapter circuit means comprising:

a source of energy connected in circuit with said thermostat and said second motor for energizing said second motor in response to a call-for-heat signal to move said damper plate to said open position, said damper operator means de-energizing said second motor when said damper plate is in said open position;

first switching circuit means including a first pair of contacts connected in circuit with said burner control means for generating said control signal to energize said burner motor and ignition circuit in response to said second signal of said damper operator means, and for removing said control signal when said call-for-heat signal is removed;

delay circuit means responsive to an input signal for generating an output signal a predetermined time after said input signal and coupled to said damper operator means for moving said damper plate to said closed position; and second switching circuit means responsive to the de-energization of said burner motor and ignition circuit when said call-for-heat signal is removed by said thermostat for generating said input signal to said delay circuit means to close said damper plate after said predetermined time has lapsed.

2. The apparatus of claim 1 wherein said oil burning unit includes a line source of voltage and a contactor adapted to connect said burner motor and ignition circuit to said line source of voltage, said contactor being actuated by said oil burner control means; and wherein said second switching means of said adapter circuit means comprises a safety relay having a coil connected in circuit with said line source and the junction between said contactor and said burner motor and ignition circuit whereby said coil is in one state when said contactor is open and in another state when said contactor is closed, said safety relay including a set of contacts connected in parallel with the contacts of said thermostat for coupling said source of power in said adapter circuit means to energize said second motor in said damper operator means to cause said damper plate to move to said open position if said burner motor and ignition circuit is energized and said thermostat contacts are open.

3. The apparatus of claim 2 wherein said contacts of said safety relay are normally closed and said first switching circuit means of said adapter circuit means includes a pair of normally closed contacts in series with said normally closed contacts of said safety relay, whereby if said first switching means is energized, said contacts thereof will open and thereby remove said contacts of said safety relay from circuit connection with said damper operator means.

4. The apparatus of claim 2 wherein said unit includes three leads interconnecting said oil burner unit with said adapter circuit means including first and second leads for connecting the terminals of said line source respectively to first and second terminals of said source of power in said adapter circuit means, and a third lead connecting the junction of said burner motor and ignition circuit means and said contactor with one terminal of said coil of said safety relay, the other terminal of said coil of said safety relay being connected to one terminal of said line source to said adapter circuit means, whereby said adapter circuit means may be assembled to said oil burner unit without breaking any electrical leads in said oil burner unit.

5. The apparatus of claim 4 wherein said first switching means comprises a simulating relay and said first contacts thereof are normally open, said apparatus further comprising a five-lead cable between said adapter circuit means and said thermostat and oil burner control circuit means including first and second leads connected respectively to the contacts of said thermostat; third and fourth leads interconnecting the normally open contacts of said simulating relay with the normal thermostat contacts of said burner control means; and a fifth lead connected to the system common of said oil burner control means.

6. The apparatus of claim 5 wherein the coil of said simulating relay is responsive to said second signal of said damper operator means when said damper plate is opened to thereafter close said simulating contacts, said simulating contacts simulating the closing effect of said thermostat contacts only after said damper plate is opened, whereby the safety timing of said oil burner control means is undiminished by the addition of said adapter circuit means.

7. The apparatus of claim 6 wherein said damper assembly includes a cam-actuated switch having normally-closed contacts in circuit with said source of voltage in said adapter circuit and said thermostat contacts and responsive to the positioning of said damper plate in the open position for actuating said normally-closed contacts thereof and returning control of said burner motor and ignition circuit to said oil burner control means, and further including a set of normally open contacts for coupling energy received from said source of energy in said adapter circuit to energize said simulating relay in said adapter circuit means only after said damper plate is in the open position.

8. The apparatus of claim 6 wherein said adapter circuit means includes a separate casing adapted to be mounted to a wall of said unit for housing the circuitry of said adapter circuit means, whereby said damper operator and adapter circuit means may be retrofitted to an existing oil burner unit without breaking electrical connections of said burner motor and ignition circuit and without adding components to the existing housing for said oil burner control means.

9. The apparatus of claim 2 wherein said source of energy and said adapter circuit means includes a transformer having a primary winding connected across a line source of power, one terminal of a secondary winding connected in circuit with the contacts of said thermostat, and further including lead means connecting the other contact of said thermostat to the winding of said second motor of said damper operator means through a normally closed set of contacts actuated by said damper plate in the open position.

10. In combination with an oil burning unit having a burner motor and ignition circuit; oil burner control means for energizing said burner motor and ignition circuit in response to a control signal; and a thermostat in a space to be heated by the unit for generating a call-for-heat signal, said unit exhausting combustion gases through a flue, the improvement comprising:

a flue damper assembly including a damper plate movable between an open position and a closed position;

damper operator means including a second motor for driving said damper plate to said positions; limit switch means for generating a first signal when said damper plate is in said closed position and a second signal when said damper plate is in said open position; and a latching relay having a coil connected in circuit with the winding of said motor and the contacts of said limit switch means for latching said motor energized when said thermostat generates a call-for-heat signal and said damper plate is closed until said second signal is generated; and adapter circuit means comprising:

a source of energy connected in circuit with said thermostat, said second motor and said latching relay for energizing said second motor and said latching relay in response to a call-for-heat signal to move said damper plate to said open position, said limit switch means de-energizing said second motor when said damper plate is in said open position;

first switching circuit means including a first pair of contacts connected in circuit with said burner control means for generating said control signal to energize said burner motor and ignition circuit in response to said second signal of said limit switch means of said damper operator means, and for removing said control signal when said call-for-heat signal is removed;

drive circuit means responsive to an input signal for generating an output signal to said second motor for moving said damper plate to said closed position; and second switching circuit means responsive to the de-energization of said burner motor and ignition circuit when said call-for-heat signal is removed by said thermostat for generating said input signal to said drive circuit means to close said damper plate.

11. The apparatus of claim 10 wherein said oil burning unit includes a line source of voltage and a contactor adapted to connect said burner motor and ignition circuit to said line source of voltage, said contactor being actuated by said oil burner control means; and wherein said second switching means of said adapter circuit means comprises a safety relay having a coil connected in circuit with said line source and the junction between said contactor and said burner motor and ignition circuit whereby said coil is in one state when said contactor is open and in another state when said contactor is closed, said safety relay including a set of contacts connected in parallel with the contacts of said thermostat for coupling said source of power in said adapter circuit means to energize said second motor in said damper operator means to cause said damper plate to move to said open position if said burner motor and ignition circuit is energized and said thermostat contacts are open.

12. The apparatus of claim 11 wherein said contacts of said safety relay are normally closed and said first switching circuit means of said adapter circuit means includes a pair of normally closed contacts in series with said normally closed contacts of said safety relay, whereby if said first switching means is energized, said contacts thereof will open and thereby remove said contacts of said safety relay from circuit connection with said damper operator means.

13. The apparatus of claim 11 wherein said unit includes three leads interconnecting said oil burner unit with said adapter circuit means including first and second leads for connecting the terminals of said line source respectively to first and second terminals of said source of power in said adapter circuit means, and a third lead connecting the junction of said burner motor and ignition circuit means and said contactor with one terminal of said coil of said safety relay, the other terminal of said coil of said safety relay being connected to one terminal of said line source to said adapter circuit means, whereby said adapter circuit means may be assembled to said oil burner unit without breaking any electrical leads in said oil burner unit.

14. The apparatus of claim 13 wherein said first switching means comprises a simulating relay and said first contacts thereof are normally open, said apparatus further comprising a five-lead cable between said adapter circuit means and said thermostat and oil burner control circuit means including first and second leads connected respectively to the contacts of said thermostat; third and fourth leads interconnecting the normally open contacts of said simulating relay with the normal thermostat contacts of said burner control means; and a fifth lead connected to the system common of said oil burner control means.

15. The apparatus of claim 14 wherein the coil of said simulating relay is responsive to said second signal of said damper operator means when said damper plate is opened to thereafter close said simulating contacts, said simulating contacts simulating the closing effect of said thermostat contacts only after said damper plate is opened, whereby the safety timing of said oil burner control means is undiminished by the addition of said adapter circuit means.

16. The apparatus of claim 15 wherein said limit switch means includes normally-closed contacts in circuit with said source of voltage in said adapter circuit and said thermostat contacts and responsive to the positioning of said damper plate in the open position for actuating said normally-closed contacts thereof and returning control of said burner motor and ignition circuit to said oil burner control means, and further including a set of normally open contacts for coupling energy received from said source of energy in said adapter circuit to energize said simulating relay in said adapter circuit means only after said damper plate is in the open position.

17. The apparatus of claim 16 wherein said limit switch means further includes second normally-open contacts actuated when said damper plate is in the closed position and connecting the winding of said second motor to said latching relay, said latching relay including normally-open contacts connected in series with the coil of said simulating relay, whereby if power is lost when said call for heat signal is being generated and said damper plate is at least partially opened, said damper operator means will cycle said plate back to the closed position and commence a new operating cycle.

18. The apparatus of claim 17 wherein said drive circuit means comprises delay circuit means for driving said second motor to close said damper plate a predetermined time after said simulating relay is de-actuated.

* * * * *